United States Patent [19]

Giovagnoli

[11] Patent Number: 4,524,749

[45] Date of Patent: Jun. 25, 1985

[54] SPRING-TYPE BALL PITCHING MACHINE

[75] Inventor: Paul S. Giovagnoli, Kansas City, Mo.

[73] Assignee: Master Pitching Machine, Inc., Kansas City, Mo.

[21] Appl. No.: 439,932

[22] Filed: Nov. 8, 1982

[51] Int. Cl.[3] ..... F41B 3/02

[52] U.S. Cl. ..... 124/7; 124/17; 273/26 D

[58] Field of Search ..... 124/6, 7, 41 R, 8, 9, 124/4, 29; 273/26 D

[56] References Cited

U.S. PATENT DOCUMENTS

| | | | |
|---|---|---|---|
| D. 189,358 | 11/1960 | Giovagnoli | D34/5 |
| 1,273,301 | 7/1918 | Wood | 124/6 |
| 2,806,461 | 9/1957 | Giovagnoli | 124/7 |
| 2,877,757 | 3/1959 | Giovagnoli | 124/7 |
| 2,918,915 | 12/1959 | Doeg | 124/78 |
| 3,136,308 | 6/1964 | Giovagnoli | 124/7 |
| 3,207,147 | 9/1965 | Giovagnoli | 124/49 |
| 3,252,453 | 5/1966 | Giovagnoli | 124/7 |
| 3,913,552 | 10/1975 | Yarur et al. | 124/78 |
| 3,977,386 | 8/1976 | Meyer | 124/7 |
| 4,015,578 | 4/1977 | Wright | 124/7 |

*Primary Examiner*—Richard J. Apley
*Assistant Examiner*—William R. Browne
*Attorney, Agent, or Firm*—Schmidt, Johnson, Hovey & Williams

[57] ABSTRACT

An improved ball pitching machine is described which can be easily adjusted so as to vary the trajectory of pitched balls, while at the same time affording maximum protection to by-standers by virtue of a selectively openable housing having an adjustable ball-clearing outlet. In preferred forms, the machine includes an elongated, rotatable ball pitching arm having a concave ball-receiving hand adjacent the outer end thereof; the hand is adjustably secured to the arm in a manner permitting variance of the angle of inclination of the hand relative to the arm, thus allowing the machine to deliver lob-type or essentially straight pitches as desired. The housing has an adjustable cover for varying the effective dimensions of the ball-clearing outlet, so that the outlet size can be correlated to a desired adjustment of the pitching hand.

3 Claims, 7 Drawing Figures

SPRING-TYPE BALL PITCHING MACHINE

BACKGROUND OF THE INVENTION

1. Field of the Invention

The present invention is broadly concerned with an improved ball pitching machine operable to selectively pitch baseballs or softballs or the like at desired, adjustable trajectories. More particularly, it is concerned with such an improved machine having an adjustable ball pitching hand along with a housing outlet which can be varied in effective dimensions so as to clear balls pitched over the entire range of trajectories afforded by the adjustable hand.

2. Description of the Prior Art

Various ball pitching machines are described in U.S. Pat. Nos. 2,806,461, 2,877,757, 3,136,308, 3,207,147, 3,252,453, and D-189,358. While all of these machines are operable to pitch baseballs or other similar objects, they are relatively costly and not suited for many amateur teams because of this drawback. As can be appreciated, a machine suitable for recreational use must meet a number of criteria, namely, relatively low cost, reliability in operation, the ability to pitch a variety of types of balls and pitches (e.g., lob-type or essentially straight pitches), and must be completely safe both during operation and storage.

SUMMARY OF THE INVENTION

The above objectives are met by the ball pitching machine in accordance with the present invention. Broadly speaking, the machine includes an elongated pitching arm having a ball-receiving hand secured to the outermost end thereof, with mechanism for rotating the arm in order to pitch balls received by the hand. Structure is also provided for successively feeding respective balls to the hand for pitching thereof, along with housing structure disposed about the rotatable arm, hand and mechanism which presents a ball-clearing outlet located to permit pitched balls to pass out of the housing structure. Cover means is also provided for substantially covering the ball outlet when the machine is not in use. The cover is mounted onto the housing structure for adjusting the position of the cover to vary the effective dimensions of the ball outlet. Finally, the ball-receiving hand is affixed to the pitching arm by means of adjustable structure permitting selective variation in the angle of inclination between the hand and arm; in this manner, the trajectory of pitched balls can be varied at will.

In use, the ball-receiving hand is adjusted relative to its carrying arm so as to achieve the desired trajectory in pitched balls. At the same time, the cover is adjusted so as to open the balls outlet sufficiently to permit the balls to be pitched. Thus, the cover and the pitching hand are both adjustable so as to permit proper correlation of the same and thus effect easy, trouble free ball pitching.

DESCRIPTION OF THE PREFERRED EMBODIMENT

Figure 1:
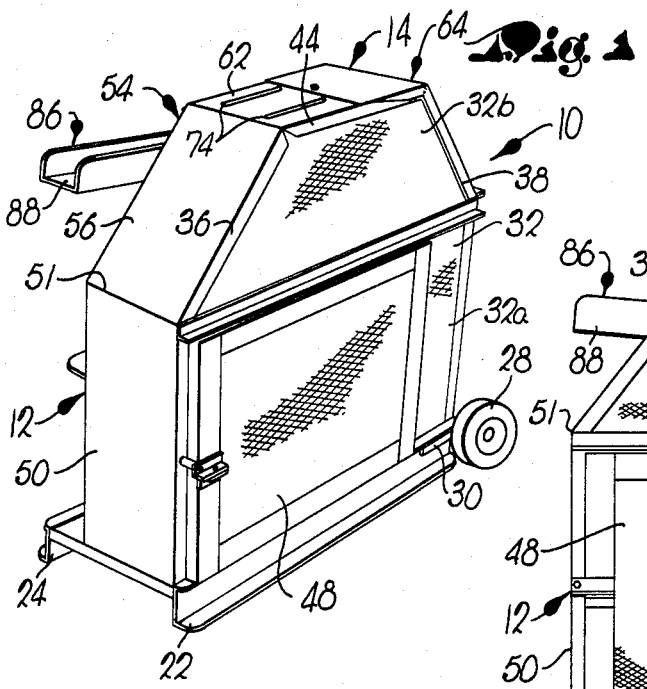
FIG. 1 is a perspective view of the ball pitching machine in accordance with the invention.

Turning now to the drawings, a ball pitching machine 10 is illustrated which broadly includes housing structure 12, adjustable cover means 14 associated with the structure 12, an elongated pitching arm 16, a ball-receiving hand 18 affixed to the outermost end of arm 16, and mechanism broadly referred to by the numeral 20 for rotating arm 16 about an axis for pitching a ball received by hand 18.

In more detail, the housing structure 12 includes a pair of lowermost, opposed, elongated side rails 22, 24 interconnected by means of cross pieces 26. A pair of spaced apart wheels 28 are affixed to the side rails 22, 24, by means of brackets 30.

Figure 2:
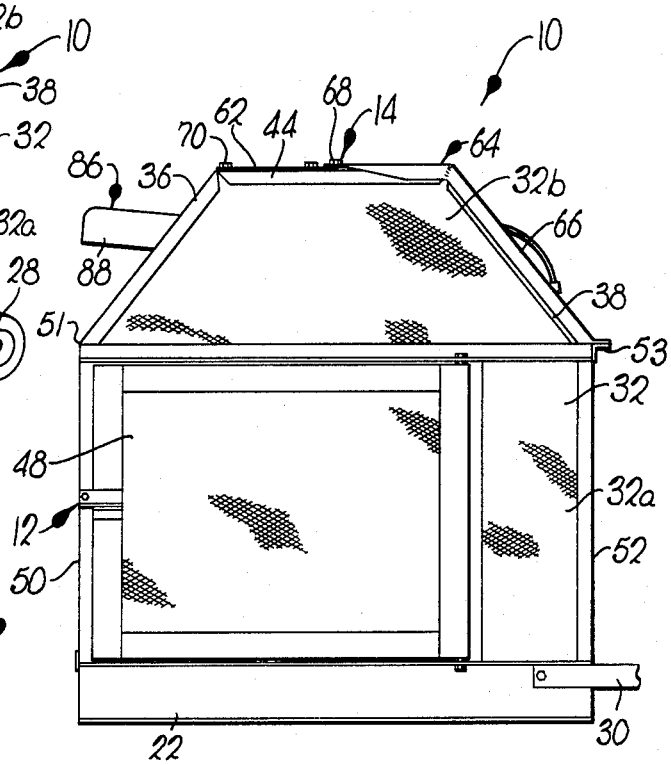
FIG. 2 is a side elevational view of the machine illustrated in FIG. 1.
Figure 3:
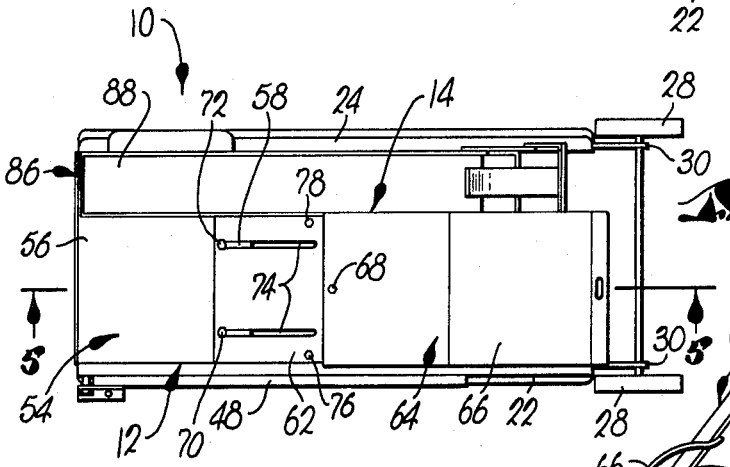
FIG. 3 is a plan view of the machine illustrated in FIGS. 1–2.
Figure 4:
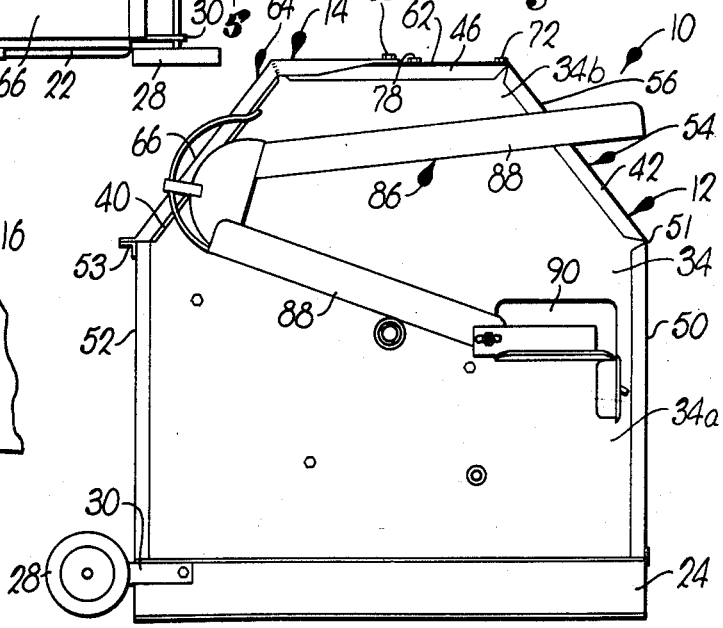
FIG. 4 is a side elevational view of the ball-pitching machine, illustrating the side thereof opposite that illustrated in FIG. 2.

The housing structure 12 further includes a pair of upright, opposed, spaced apart sidewalls 32, 34 each having a rectangular lower portion **32*a*, 34*a*, and a trapezoidal upper portion 32*b*, 34*b*. The upper portions each present a pair of inclined, converging end margins 36, 38 and 40, 42, as well as a horizontal top margin 44, 46. As best seen in FIGS. 1, 2 and 4, the sidewall 32 is advantageously a mesh screen whereas the wall 34 is solid. In addition, the wall 32 has an openable door 48** formed therein to permit access to the interior of the housing.

A pair of rectangular, upright end walls 50, 52 interconnect the sidewalls 32, 34, and specifically the respective rectangular portions thereof **32*a* 34*a*. Wall 50 is solid and includes upper margin 51, whereas wall 52** is in the form of wire mesh.

Finally, the housing structure 12 includes a top wall 54 having an inclined portion 56 joining the opposed, inclined margins 36, 40 of the respective portions **32*b*, 34*b*. The overall top wall further includes a horizontal section 58 which extends between the top margins 44, 46. The section 58 is of lesser length than the length of the margins 44, 46, and extends from the upper adjacent end of inclined portion 56 along a portion of the length of the top margins. Ball outlet 60 is located between the top wall 54 and upper margin 53 of end wall 52**.

Adjustable cover means 14 includes an elongated, planar, intermediate connection section 62 situated between and extending along a portion of the length of the sidewall top margins 44, 46, and a second section 64 including an inclined portion 66 configured to be complemental with the pair of inclined sidewall end margins 38, 40. The cover 14 is of a length to extend between the top wall 54 and the upper margin 53 of end wall 52 for substantially covering the ball outlet 60. The second cover section 64 is pivotally secured to the intermediate section 62 by bolt and nut assembly 68. The intermediate connection section 62 is slidably connected to top wall 54 by nut and bolt assembies 70, 72. Nut and bolt assemblies 70, 72 are received through parallel, elongated grooves 74 in the intermediate section 62 of cover 14. Additionally, releasable nuts 76, 78 are removably received through connection section 62 of cover 14 and top margins 44, 46 of sidewalls 32, 34.

Figure 7:
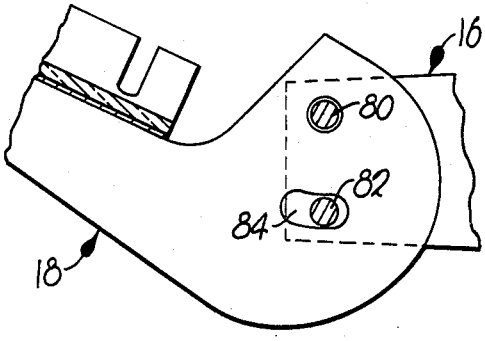
FIG. 7 is an enlarged, fragmentary view illustrating in detail the preferred connection structure between the ball pitching arm and hand.

Referring in particular to FIG. 7, it will be noted that hand 18 is adjustably connected to throwing arm 16 by a pair of bolts 80, 82. Bolt 82 extends through slot 84 in hand 18, enabling hand 18 to be pivoted about bolt 80 for selective adjustment of the angle of inclination of hand 18 relative to the arm 16.

The pitching machine 10 includes ball feeding means 86 comprising a ball holding tray 88 situated exteriorly of the housing structure 12. The housing 12 includes a ball clearing inlet 90 communicating the lower end of tray 88 with the interior of housing 12.

The mechanism 20 for rotating arm 16 includes motor 92, belt and pulley assemblies 94, 96, and arm driving gear 98 connected to the belt and pulley assemblies by chain 100. Arm-engaging element 102 is fixedly attached to and projects outwardly from gear 98. Arm 16 is connected to spring assembly 104 by an over center actuated tensioning and release mechanism 106.

Figure 5:
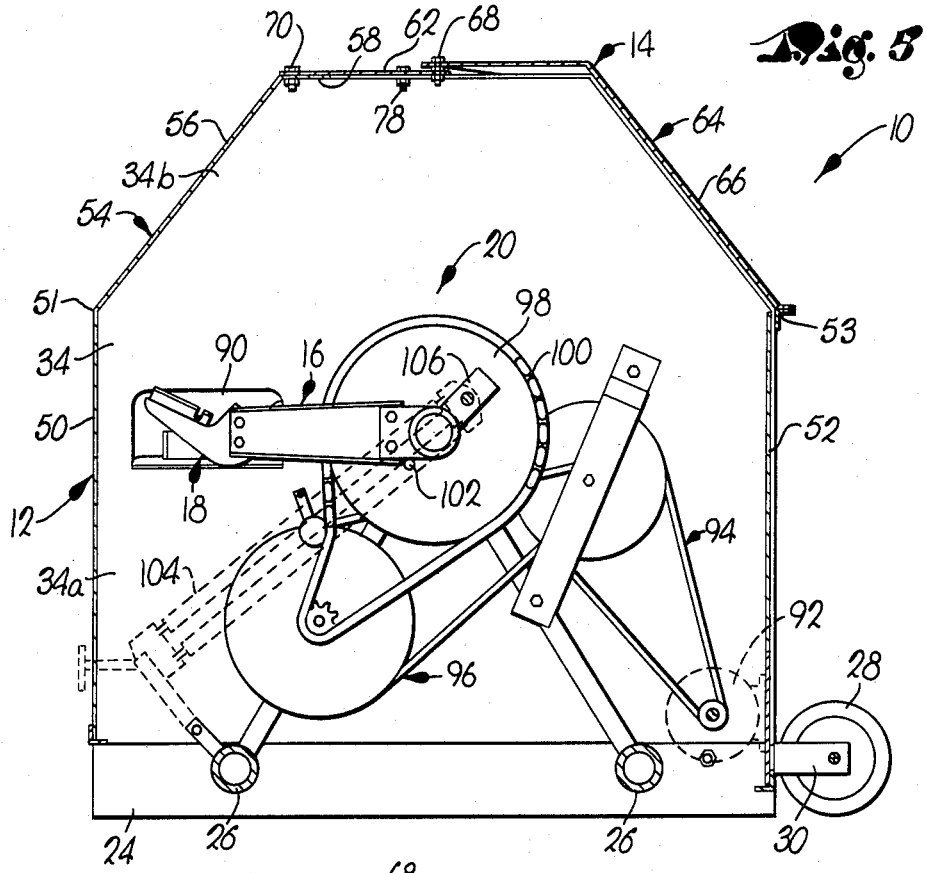
FIG. 5 is a vertical sectional view taken along line 5—5 of FIG. 3, and illustrating the internal components of the machine, with the housing cover in position closing the ball-clearing outlet.
Figure 6:
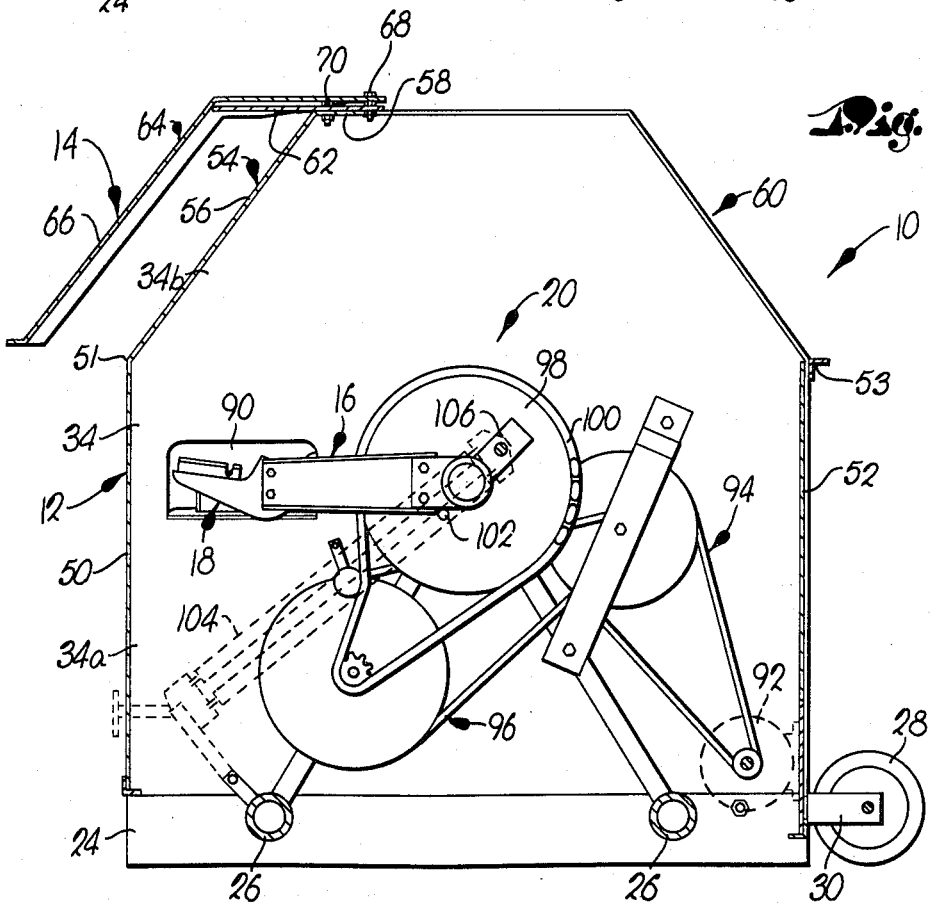
FIG. 6 is a view similar to that of FIG. 5, but illustrates the cover in its recessed position presenting a ball-clearing outlet of maximum dimensions.

In operation, pitching arm 16 will be rotated in a clockwise direction, as seen from the perspective of FIGS. 5 and 6, by gear 98. Spring assembly 104 will be tensioned by the rotation of arm 16 until such time as the over center mechanism 106 releases the tension of the spring and imparts the energy stored in the spring to pitching arm 16. A baseball will be put within hand 18 of pitching arm 16 by ball chute 88 at ball inlet 90, and the baseball will be thrown from the pitching machine through outlet 60 when the pitching arm 16 is rapidly accelerated by spring assembly 104.

The path of travel of balls pitched from pitching machine 10 may be varied by adjusting the angle of inclination of the hand 18 relative to pitching arm 16. That is to say, when the pitching hand 18 is inclined as depicted in FIG. 5, the ball will be pitched in a relatively straight trajectory. When the pitching hand is rotated in a counterclockwise direction, to the perspective of FIG. 6, the ball will be pitched from pitching machine 10 in an arched trajectory.

It is desirable to store the pitching machine 10, when not in use, with the cover means 14 completely covering the ball outlet 60. When the pitching machine 10 is ready for use, however, cover means 14 may be shifted away from the ball outlet 60, and, moreover, may be adjusted to vary the effective dimensions of ball outlet 60 and thereby accommodate the pitching of balls on either a straight or arched trajectory. To accommodate balls pitched on a straight trajectory, the second cover section 64 of cover means 14 is merely pivoted about bolt 68 out of covering relationship with ball outlet 60. To accommodate balls pitched on an arched trajectory, securing bolts 76, 78 are first removed from the intermediate connection section 62 of cover means 14, the second cover section 64 is then pivoted about bolt 68 out of covering relationship with ball outlet 60, and the entire cover means 14 is shifted rearwardly to the position depicted in FIG. 6.

I claim:

1. A ball pitching machine comprising:

an elongated pitching arm;

a ball-receiving hand secured to said arm;

mechanism for rotating said arm about an axis;

means for successively feeding respective balls to said hand for pitching thereof;

housing structure disposed about said arm, hand and mechanism, including structure defining a ball outlet located to permit pitched balls to pass out of said housing structure, said housing structure including-- a pair of upright, opposed, spaced apart sidewalls each having a rectangular lower portion and a trapezoidal upper portion, with the upper portions each presenting a pair of inclined, converging end margins and a horizontal top margin, a pair of upright, opposed, spaced apart, end walls joining said sidewall portions, and a top wall including an inclined section joining one opposed pair of said converging end margins, and a horizontal wall section of lesser length than the length of the opposed top margins, said top wall section extending from the adjacent end of said inclined section and along said top margins for a portion of the length thereof;

cover means for substantially covering said ball outlet when said machine is not in use, said cover means including-- an elongated planar, intermediate connection section situated between and extending along the length of said opposed top margins, a second section including an inclined portion configured to be complemental with the pair of inclined converging end margins spaced from said one pair thereof, and a bolt means connecting said intermediate section and said second section for permitting pivoting of the second section about an upright axis; and means mounting said cover on said housing structure, including means for adjusting the position of the cover to vary the effective dimensions of said ball outlet, having-- releasable means coupling said intermediate section to said top wall section, including structure for permitting shifting of the intermediate section relative to said top wall portion.

2. The ball pitching machine as set forth in claim 1, there being means mounting said hand to said arm including structure for selective adjustment of the angle of inclination of said hand relative to said arm.

3. The ball pitching machine as set forth in claim 2, said adjustment structure comprising means defining an elongated adjustment slot in said hand, and bolt means extending through said slot and coupled to said arm.

* * * * *